US006688942B2

(12) United States Patent
Holliday

(10) Patent No.: US 6,688,942 B2
(45) Date of Patent: Feb. 10, 2004

(54) ACTIVITY BRA AND METHOD OF PRODUCING SAME

(76) Inventor: David L Holliday, 903 Blockade La., James Island, SC (US) 29412

( * ) Notice: Subject to any disclaimer, the term of this patent is extended or adjusted under 35 U.S.C. 154(b) by 0 days.

(21) Appl. No.: 10/098,251

(22) Filed: Mar. 15, 2002

(65) Prior Publication Data

US 2002/0132558 A1 Sep. 19, 2002

Related U.S. Application Data

(60) Provisional application No. 60/276,233, filed on Mar. 15, 2001.

(51) Int. Cl.[7] ..... A41C 3/00
(52) U.S. Cl. ..... 450/39; 450/1; 450/54
(58) Field of Search ..... 450/1, 39, 53, 450/54–58, 89, 92, 30–32, 36; 2/455, 463, 92, 267; 623/7, 8; 602/5–8, 19

(56) References Cited

U.S. PATENT DOCUMENTS

| | | | | | |
|---|---|---|---|---|---|
| 4,607,640 | A | * | 8/1986 | McCusker | 450/39 |
| 5,022,887 | A | * | 6/1991 | Lawson | 450/54 |
| 5,244,432 | A | * | 9/1993 | Moy Au et al. | 450/54 |
| 5,769,688 | A | * | 6/1998 | Holliday | 450/57 |

* cited by examiner

*Primary Examiner*—Gloria M. Hale
(74) *Attorney, Agent, or Firm*—B. Craig Killough

(57) ABSTRACT

An activity bra comprising a shield that is inserted into a harness having pockets that receive the shield. The harness has an adjustment device that allows the shield to be pulled against the breasts to compress the breasts of the wearer. A process for producing a suitable shield is described.

12 Claims, 3 Drawing Sheets

ACTIVITY BRA AND METHOD OF PRODUCING SAME

This application claims priority of provisional application serial No. 60/276,233, filed Mar. 15, 2001.

FIELD OF THE INVENTION

The present invention relates to the field of breast and chest protectors for women and is more particularly directed to a method of producing a breast and chest area protector for women who play team sports or are otherwise involved in activities that involve a high degree of bodily movement and physical contact.

BACKGROUND OF THE INVENTION

Increasing numbers of women are becoming involved in team sports and other physical activities. These activities subject women to risks of injuries. Some of these risks are unique to women. Frequently, women athletes are not adequately protected from direct impact to the breast or chest area. Such impact may result in serious bruising, or long-term medical problems. Different types of athletic activities have different levels of bodily movement and physical contact. Although the sports of soccer, basketball and even baseball are considered non-contact sports, there is still a high degree of dynamic contact, especially in basketball and soccer when multiple players are rushing to a single ball in play. Impact to the breast and chest area from a flying ball may also cause serious injury to a female athlete. This is particularly true in the games of softball and baseball where the ball is hard and travels at high speeds. In addition to injuries caused by physical contact, injuries may also arise from rigorous bodily movement even from non-contact activities such as aerobics.

A need exists for a breast and chest protector for women that will reduce the risk of injury from contact. The device must reduce movement of the breasts, since movement of the breasts while running increases the likelihood of injury to the breasts. Further the device must compress the breasts, since compressed breasts are more resistant to injury from impact or trauma. However, breast sizes vary greatly from woman to woman. Accordingly, the breast and chest protector must be made by a process that will provide for compression of breasts of various sizes.

SUMMARY OF THE INVENTION

It is therefore an objective of this invention to provide adequate protection to women athletes from significant impact to the breast and chest area. It is further an objective of this invention to provide a breast and chest protector for women that provides compression for individual breasts and which is sized to provide compression for various sizes of breasts.

The bra comprises a shield. The shield is inserted into a harness having pockets that receive the shield. The harness has adjustment means that allows the shield to be pulled against the breasts to compress the breasts. The shield is molded to a known cup size and formed to materially compress the breasts of that cup size.

DESCRIPTION OF THE PREFERRED EMBODIMENT

Figure 1:
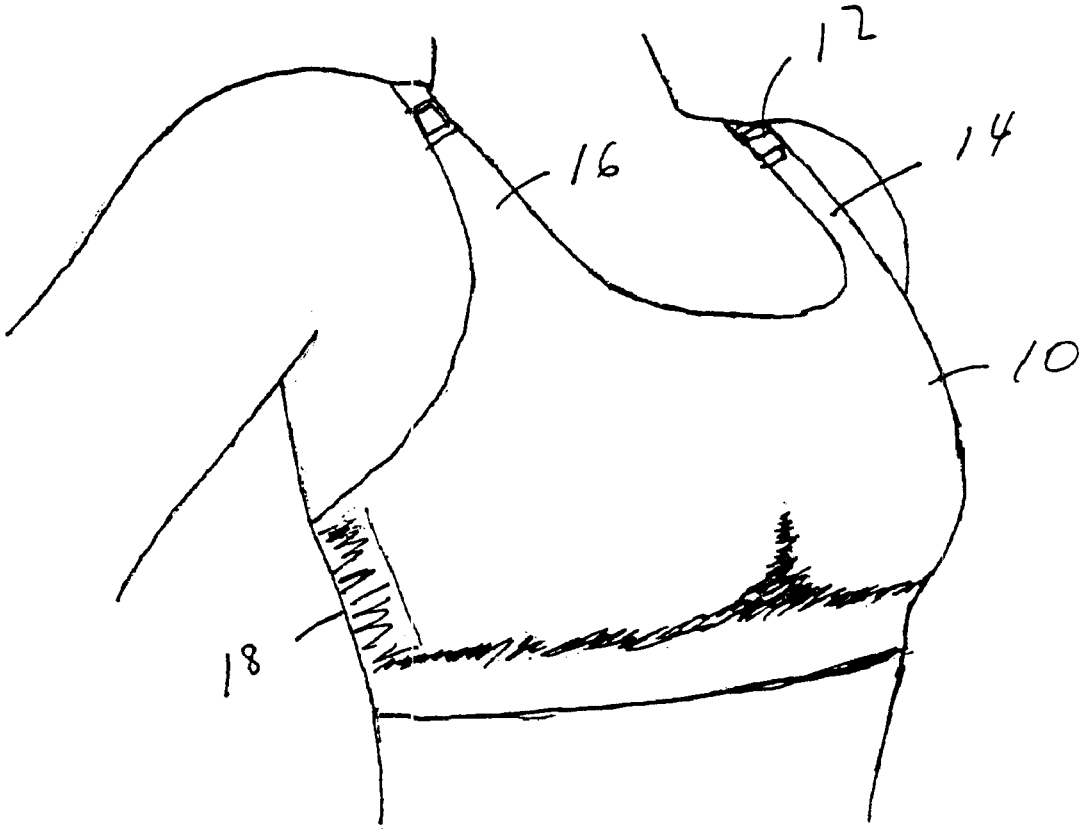
FIG. 1 is the bra of the present invention.

The primary object of the invention is to provide a bra that compresses female breasts to make the breasts more resistant to injury from movement, contact or trauma. The bra of the invention may be comprised of a unitary shield having a first cup and a second cup. "Unitary" means that the shield is formed as a single unit that comprises a left cup, a right cup and a center member that connects the cups, and is not formed of a left cup and a right cup that are connected only by a separately formed piece or part. The shield is inserted into a textile harness having pockets in the cups of the harness that receive the shield. The harness has adjustment means that allows the shield to be pulled against the breasts to compress the breasts.

To form the shield, a bra, such as a sports bra, may be used to compress the breasts of a live model. A moldable material is then used to obtain an impression of the breasts. The moldable material is placed over the sports bra and allowed to form. The moldable material is allowed to harden. A second moldable material fills the first moldable material, and is allowed to harden. The second moldable is removed from the first moldable material and is sanded smooth to form a mock up. A mold for plastic forming, such as vacuum forming is them prepared from the mock up. The shield is then vacuum formed from an appropriate material. This process is performed to create shields of various sizes according to the size of breasts to be protected. The shield is then inserted into a harness having a first cup and a second cup, with each cup having a pocket that receives the shield.

The shield of the preferred embodiment is formed of a hard, but resilient and flexible, material. The material may be a plastic, and may be a low density polyethylene. The shield is preferred to have a thickness of 0.05 inches to 0.20 inches, with the thickness depending upon the application. A thinner shield may be used to form a bra for non-contact activities, such as aerobics, while a thicker shield is preferred for sports involving contact and impact, such as soccer, softball or basketball.

A plastic shield may be formed by vacuum means. However, other methods of plastic forming may be used. It is imperative, however, that whatever molding or forming method is used, that the shield and harness produced by the invention provide a bra which materially compresses the breasts.

To create a mold for the shield, a model, such as a live model, having a known bra cup size (for example, cup size B), is fitted with a bra having a high degree of elasticity in the cups. Sports bras, as known in the art, typically have a high degree of elasticity when such bras are new, before significant washing. Accordingly, it is preferred to use a new sports bra. Further, the bra to be used should not have exterior decoration, and should not be padded. Sports bras typically meet these requirements. A sports bra which is manufactured by CHAMPION® may be used.

The sports bra of the appropriate cup size for the model, for example cup size B, is fitted to the model. The sports bra is adjusted by means of adjustable straps so that it fits tightly, and compresses the breasts as completely as possible. After the sports bra is fitted, a formable material is placed completely over the cup portion of the bra. The preferred formable material is plaster. Plaster bandages, such as those used to form plaster casts, may be used. M-Pact of Eudora, Kans., sells plaster bandage material of a type that may be used.

Strips of the plaster bandage are cut to fit an area that extends from underneath one arm of the model to underneath the opposite arm. A sufficient number of strips are cut to completely cover the cups of the bra from top to bottom and from underneath one arm to underneath the opposite arm. The plaster bandage strips are then dipped in water according to the manufacturers instructions for the plastic bandage, and then removed. Excess water is squeezed out, and the bandage is applied so as to contact all contours of the bra cups. After the bra cups are completely covered top to bottom, and from underneath one arm to underneath the opposite arm, the plastic bandage is allowed to set. After the plaster bandage is set, the bra and plaster bandages are removed. The bra is subsequently separated from the plaster bandage.

The impression provided by the plaster cast is modified by applying additional strips of plaster bandage to the sides that are opposite the portion of the impression that was underneath the wearer's arms, so that an enclosed bowl is formed. A mold is formed from the plaster bandage impression.

In one embodiment, a mock up for the mold may be formed from molding clay. Molding clay is placed into the impression to fill the impression. The molding clay is allowed to set. The impression formed of the plaster bandages is separated from the clay so that a mock up results. The mock up is then sanded to remove lines that may be formed in the mock up from the bra. A skilled mold maker may then prepare a mold for plastic forming the shield by known means. The mold so formed may be suitable for vacuum forming, injection molding or other known plastic forming means.

This process is repeated for each cup size desired. While the shield may be formed for A-cups, B-Cups, C-cups, etc., the shield may also be formed for any intermediate size, or for a combination of cup sizes. For example, a left portion of the shield may be the size of an A-cup, and the right portion may be the size of a B cup, according to the required application.

Figure 2:
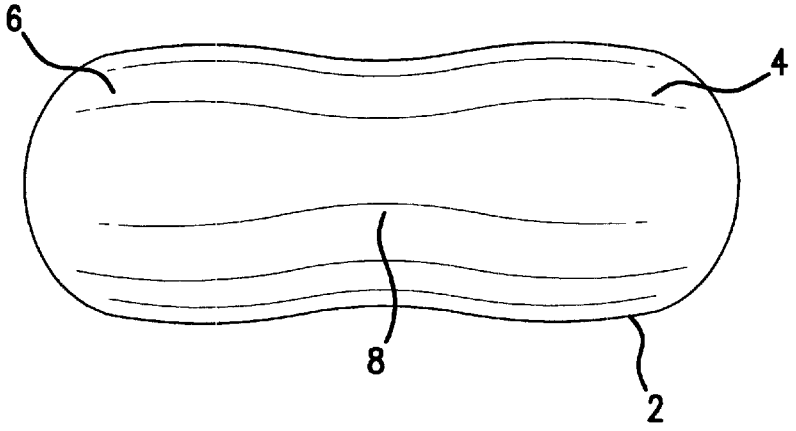
FIG. 2 is the shield that is inserted in the harness.

The resulting shield 2 is a unitary member having a left cup 4 and a right cup 6, connected by a center section 8 that may cover the sternum area. FIG. 2. The shield completely covers the breasts, and is formed to the contours of the breast of the wearer, so that when the shield is inserted into the sports bra as described below, the shield will adequately compress and shield the breasts, to resist injury.

Figure 3:
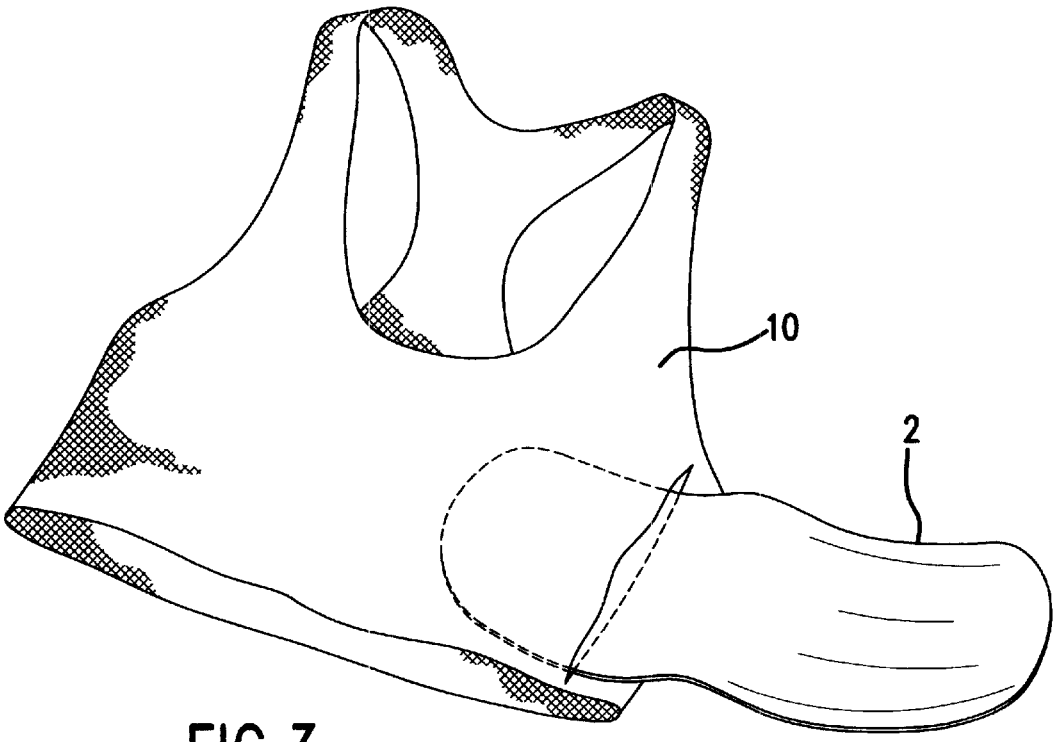
FIG. 3 demonstrates the shield being inserted into the harness, with the harness shown as being turned inside out.
Figure 4:
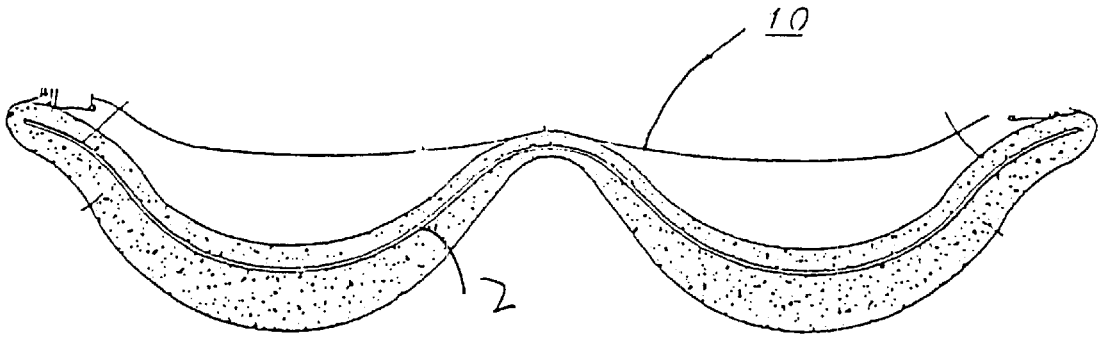
FIG. 4 is a sectioned view of a portion of the bra, with the shield in place, and the cups of the harness shown.

The shield is inserted into a specially designed harness that has a pocket formed in the left cup and a pocket formed in the right cup that will receive and hold the shield. The shield is inserted into the pockets, and is retained within the pockets. FIG. 3. The retention means may be a result of elasticity in the fabric, wherein the fabric is stretched to insert the shield, and then retracts to hold the shield within the pocket. Alternatively, the shield may be retained within the pocket by fasteners, such as zippers, snaps, hooks, buttons, hook and loop material, or other fasteners that are known and used in clothing applications.

The harness has a left shoulder strap 14, a right shoulder strap 16, and a back strap 18. FIG. 1. The shoulder straps are be capable of adjustment, that is, they should have adjustment means 12 which will allow the harness to be tightened against the wearer, such as by reducing the effective length of the straps. The back strap should either have a significant elastic property which will cause the cups to be pulled toward the wearer, or to alternatively, should have adjustment means which will allow the effective length of the back strap to be reduced to tighten the back strap. The harness is preferred to be formed of high quality woven cotton/Lycra™, which "breathes" but has sufficient elasticity to pull the shield against the breasts and retain the shield to compress the breasts as required by the invention.

The harness having the shield in place is fitted to the wearer. The straps are tightened so that the cups of the sports bra, with shield in place, are pulled tightly against the breasts, and the shield compresses the breast as it is pulled against the breast and toward the wearer by the straps of the sports bra.

The shield and harness are formed to the contours to compress the breasts to limit movement and provide support. Movement of the breasts while running or moving is a singular motion due to the unitary structure of the shield.

In summary, the activity bra of the preferred embodiment is comprised of a unitary shield having a first cup and a second cup. The shield is inserted into a harness having pockets in the cups of the harness that receives the shield. The harness has adjustment means that allows the shield to be pulled against the breasts to compress the breasts. The shield is prepared from an impression of a bra that compresses the breasts of a model. A moldable material is then used to obtain an impression of the breasts by placing the moldable material over the sports bra and allowing it to form. A second moldable material fills the first moldable material, and is allowed to harden. The second moldable is removed from the first moldable material and is sanded smooth to form a mock up. A mold for plastic forming is prepared from the mock up. The shield is then formed from an appropriate material. This process is performed to create shields of various sizes according to the size of breasts to be protected. The shield is inserted into a harness having a first cup and a second cup, with each cup having a pocket that receives the shield. The bra so formed is fitted to a user, with the harness pulling the shield tightly against the breasts of the wearer to compress the breasts.

What is claimed is:

1. A process of producing an activity bra comprising the steps of:

producing a shield having a right cup and a left cup, wherein said right cup and said left cup are joined and connected by a center section, providing a harness comprising a right pocket and a left pocket, said harness having at least one adjustment device, and inserting said right cup of said shield into said right pocket of said harness and inserting a left cup of said shield into said left pocket of said harness, wherein shield is retained within said right pocket and said left pocket, and tightening said harness by manipulation of said at least one adjustment device, wherein said harness pulls said shield, and said shield compresses breasts of a wearer.

2. A process of producing an activity bra as described in claim 1, wherein said shield is a unitary member.

3. A process of producing an activity bra as described in claim 1, wherein said shield is formed of a material having a hardness and a resiliency of polyethylene.

4. A process of producing an activity bra as described in claim 1, wherein said shield is formed of a material having a hardness and a resiliency of polyethylene that is 0.05 inches to 0.20 inches thick.

5. A process of producing an activity bra comprising the steps of: producing a shield by a process comprising the steps of compressing a left breast and a right breast of a model having a known cup size, covering said left breast while compressed and said right breast while compressed with a moldable material, producing a mold from moldable material, forming the shield from said mold, said shield having a right cup and a left cup, wherein said right cup and said left cup are joined by a center section, providing a harness comprising a right pocket and a left pocket, said harness having at least one adjustment device, and inserting said right cup of said shield into said right pocket of said harness and inserting a left cup of said shield into said left pocket of said harness, wherein shield is retained within said right pocket and said left pocket, and tightening said harness by manipulation of said at least one adjustment device, wherein said harness pulls said shield, and said shield compresses breasts of a wearer.

6. A process of producing an activity bra as described in claim 5, wherein said shield is a unitary member.

7. A process of producing an activity bra as described in claim 5, wherein said shield is formed of a material having a hardness and a resiliency of polyethylene.

8. A process of producing an activity bra as described in claim 5, wherein said shield is formed of a material having a hardness and a resiliency of polyethylene that is 0.05 inches to 0.20 inches thick.

9. A process of producing an activity bra comprising the steps of:

producing a shield by a process comprising the steps of placing a bra having a known cup size over breasts of a model having the same known cup size, tightening the bra to materially compress the breasts of the model, covering the bra with a moldable material and allowing the moldable material to set, thereby producing an impression, producing a mold from the impression, forming the shield from the mold, said shield having a right cup and a left cup, wherein said right cup and said left cup are joined by a center section, providing a harness comprising a right pocket and a left pocket, said harness having at least one adjustment device, and inserting said right cup of said shield into said right pocket of said harness and inserting a left cup of said shield into said left pocket of said harness, wherein shield is retained within said right pocket and said left pocket, and tightening said harness by manipulation of said at least one adjustment device, wherein said harness pulls said shield, and said shield compresses breasts of a wearer.

10. A process of producing an activity bra as described in claim 5, wherein said shield is a unitary member.

11. A process of producing an activity bra as described in claim 5, wherein said shield is formed of a material having a hardness and a resiliency of polyethylene.

12. A process of producing an activity bra as described in claim 5, wherein said shield is formed of a material having a hardness and a resiliency of polyethylene that is 0.05 inches to 0.20 inches thick.

* * * * *